US005630759A

United States Patent [19]

Lee

[11] Patent Number: 5,630,759

[45] Date of Patent: May 20, 1997

[54] DEVICE USED WITH BILLIARD TABLE FOR SENSING BALLS DROPPING INTO THE POCKETS AND SCORING AS WELL AS COLLECTING AND ARRANGING THE BALL

[76] Inventor: Pei-Ju Lee, No. 22, Lane 25, Fu-Der-One Road, Ling-Ya, Kaohsiung, Taiwan

[21] Appl. No.: 584,207

[22] Filed: Jan. 4, 1996

[51] Int. Cl.[6] ..... A63D 15/00

[52] U.S. Cl. ..... 473/23; 473/26; 473/24

[58] Field of Search ..... 473/23, 33, 24, 473/25, 26, 27

[56] References Cited

U.S. PATENT DOCUMENTS

| | | | |
|---|---|---|---|
| 2,552,675 | 5/1951 | Hauflaire | 473/24 |
| 3,498,611 | 3/1970 | Kotler | 473/24 |
| 3,910,576 | 10/1975 | Leonhart | 473/24 |
| 5,302,154 | 4/1994 | Sundstorm | 473/24 |

FOREIGN PATENT DOCUMENTS

| | | | |
|---|---|---|---|
| 446859 | 5/1936 | United Kingdom | 473/23 |
| 2131303 | 6/1984 | United Kingdom | 473/23 |

*Primary Examiner*—Theatrice Brown

*Attorney, Agent, or Firm*—Morton J. Rosenberg; David I. Klein

[57] ABSTRACT

A device used with billiard table for sensing balls dropping into the pockets and scoring as well as collecting and arranging the balls. The device is mounted under the dropping opening of the collecting ball rail of the billiard table for sensing the balls hit down into the pocket and automatically scoring as well as locating the balls at the location in the ball holding tray. After all the balls on the table are hit down, sensed and rendered in the ball holding tray, the device automatically re-arranges the balls at the preset triangular location on the billiard table for next game.

1 Claim, 12 Drawing Sheets

DEVICE USED WITH BILLIARD TABLE FOR SENSING BALLS DROPPING INTO THE POCKETS AND SCORING AS WELL AS COLLECTING AND ARRANGING THE BALL

BACKGROUND OF THE INVENTION

The present invention relates to a device used with billiard table for sensing balls dropping into the pockets and scoring as well as collecting and arranging the balls.

Nowadays, a billiard table is widely used in various kinds of games such as nine-ball, fourteen-one and snooker. In these games, commonly, a player uses a cue to hit a white cue ball which in turn hits a color ball into a pocket for some scores. In these games, the player must score the balls hit into the pockets. When one frame is over, the player must take out and re-arrange the balls collected in a ball tray under the billiard table at a preset location on the table for next frame.

The existing billiard table is equipped with no such design as to automatically score and automatically take and re-arrange the collected balls on the table. Therefore, the player himself/herself inevitably must score and re-arrange the balls during the game. This more or less will make the player feel bored and interrupt the concentration of the player.

In contrast, with respect to bowling game, automatically scoring and pin re-arranging device has been well developed to minimize the error in scoring and expedite the joy in the game.

SUMMARY OF THE INVENTION

It is therefore an object of the present invention to provide a device used with a billiard table for sensing balls dropping into the pockets and scoring as well as collecting and arranging the balls. The device is mounted under the dropping opening of the collecting ball rail of the billiard table for sensing the balls hit down into the pocket and automatically scoring as well as locating the balls at the location in the ball holding tray. After all the balls on the table are hit down, sensed and rendered in the ball holding tray, the device automatically re-arranges the balls at the preset triangular location on the billiard table for next game.

The present invention can be best understood through the following description and accompanying drawing, wherein:

DETAILED DESCRIPTION OF THE PREFERRED EMBODIMENT

Figure 1:
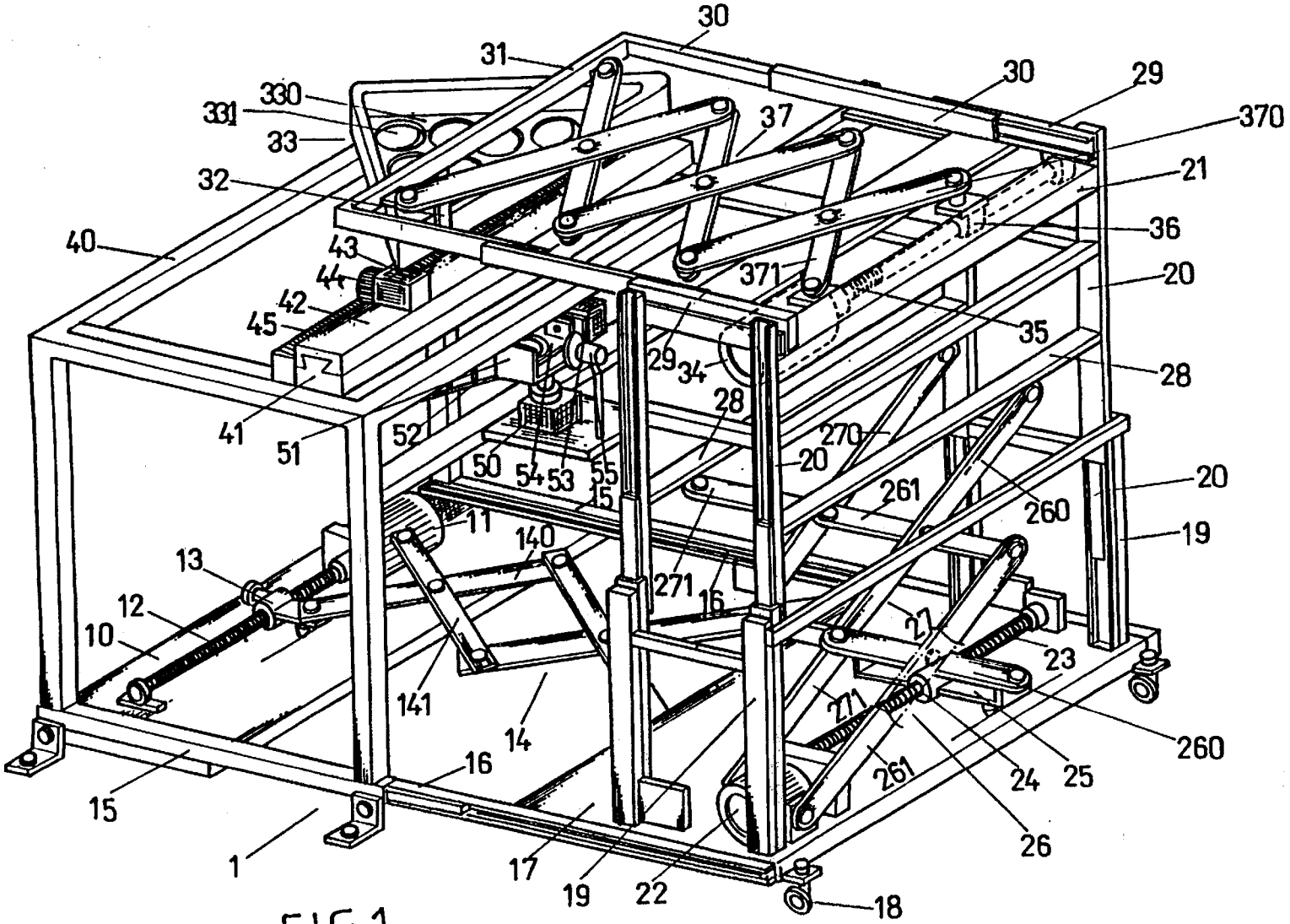
FIG. 1 is a perspective view of the present invention.

Please refer to FIG. 1. A servomotor 11 is disposed on a platform 10 on one side of a base frame 1. The output shaft of the servomotor 11 is connected with one end of a transmission thread rod 12. The other end of the thread rod 12 is coupled with a bearing and secured on the platform 10. On the thread rod 12 is coupled a thread sleeve 13 which is pivotally connected with one end of an elbow arm 140 of an extensible elbow jointed lever 14. One end of the other elbow arm 141 of the elbow jointed lever 14 is pivotally connected with a projecting board of the servomotor 11. Two rail tubes 15 are respectively disposed along a front and a rear sides of the platform 10. Several telescopically slidable rail bars 16 are fitted in each rail tube 15. The last slidable rail bar 16 is further connected with another platform 17 under which several casters 18 are mounted. The other ends of the elbow arms 140, 141 of the elbow jointed lever 14 are pivotally connected with the platform 17. The servomotor 11 through the thread rod 12 drives the thread sleeve 13 to move therealong, making the elbow jointed lever 14 extend or retract so as to move the platform 17 back and forth.

Four vertical rail tubes 19 are respectively disposed on four corners of the platform 17. Several telescopic slidable rail bars 20 are fitted in each rail tube 19. Between the ends of the last rail bars 20 is connected a seat board 21. Another servomotor 22 is disposed on a corner of the platform 17 with its output shaft coupled with a transmission thread rod 23. The other end of the thread rod 23 is coupled with a bearing and secured on the platform 17. A thread sleeve 24 is screwed on the thread rod 23. The thread sleeve 24 has two vane sections 25 on two sides which are respectively pivotally connected with one end of an elbow arm 260, 270 of each of two elbow jointed levers 26, 27. (The pivot end of the elbow arm 270 is shaded, and not shown in FIG. 1.) One end of the other elbow arm 261, 271 of each elbow jointed lever 26, 27 is pivotally connected with the projecting boards of the servomotor 22. In addition, between each two last slidable rails 20 is connected a support beam 28. The other ends of the elbow arms 260, 261 and 270, 271 of the elbow jointed levers 26, 27 are respectively pivotally connected to the support beams 28. The servomotor 22 through the thread rod 23 drives the thread sleeve 24 to move therealong, making the elbow jointed levers 26, 27 extend or retract so as to move the seat board 21 up and down.

Two rail tubes 29 are respectively disposed along a front and a rear sides of the seat board 21. Several telescopic slidable rail bars 30 are fitted in each rail tube 29. Between the ends of the last slidable bars 30 is connected a beam member 31. Under the beam member 31 are connected two interconnecting plates 32 for connecting with a triangular ball holding tray 33. A servomotor 34 is disposed under the seat board 21. The output shaft of the servomotor 34 is connected with one end of a transmission thread rod 35. The end of the thread rod 35 is coupled with a bearing and secured under the seat board 21. On the thread rod 35 is coupled a thread sleeve 36 which is pivotally connected with one end of an elbow arm 370 of an extensible elbow jointed lever 37. One end of the other elbow arm 371 of the elbow jointed lever 37 is pivotally connected with an projecting board of the servomotor 34. The other ends of the elbow arms 370, 371 of the elbow jointed lever 37 are pivotally connected with the beam member 31. The servomotor 34 through the thread rod 35 drives the thread sleeve 36 to move therealong, making the elbow jointed lever 37 extend or retract so as to move the ball holding tray 33 back and forth.

Figure 2:
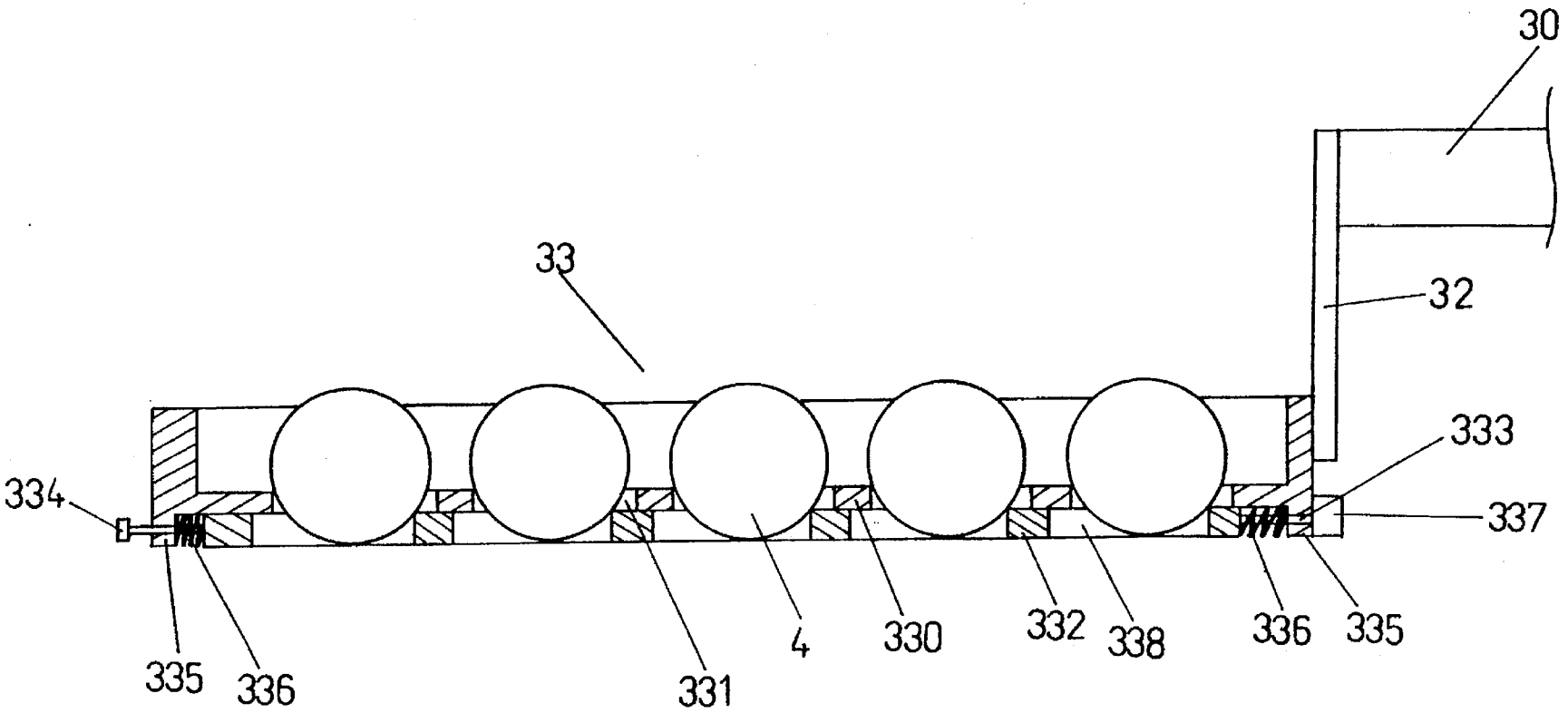
FIG. 2 is a sectional view of the ball holding tray of the present invention.
Figure 3:
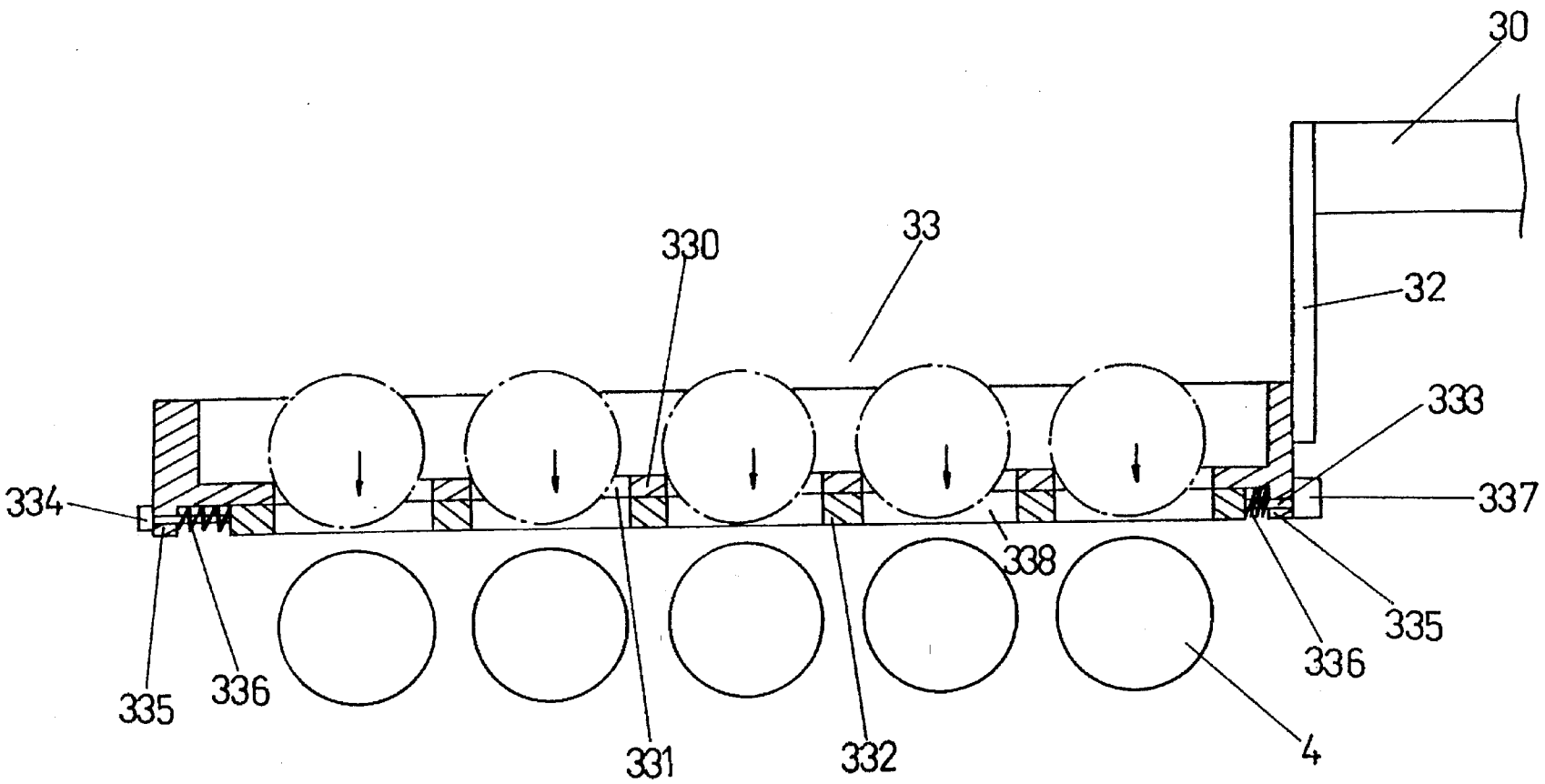
FIG. 3 is a sectional view according to FIG. 2, wherein the stopper board is shifted, permitting the balls in the ball holding tray to drop down.

Please refer to FIG. 2 which shows the structure of the ball holding tray 33. The ball holding tray 33 has a bottom board 330 formed with multiple ball holes 331 arranged as a triangular pattern. (In this embodiment, there are 15 ball holes on the bottom board 330.) A stopper board 332 is disposed immediately adjacent to the lower face of the bottom board 330. The stopper board 332 has the same shape as the bottom board 330 and formed with the same number, size and pattern of through holes 338 as the bottom board 330. However, the through holes 338 are slightly eccentrical from the ball holes 331 of the bottom board 330 so that the edges of the through holes 338 can stop the balls 4 in the ball holes 331 from dropping down from the ball holding tray 33. The stopper board 332 is engaged with the bottom board 330 in such a manner that at least one front insertion pin 333 and at least one rear insertion pin 334 are respectively disposed at a front and a rear ends of the stopper board 332 and inserted through a front and a rear flanges 335 of the ball holding tray 33. (In this embodiment, there are two front insertion pin 333 and one rear insertion pin 334.) A spring 336 is disposed between each insertion pin 333, 334 and the flange 335. A solenoid switch 337 is disposed at an outer end of the front insertion pin 333 for controlling the forward or rearward movement of the stopper board 332. Accordingly, the through holes 338 of the stopper board 332 are aligned with the ball holes 331 of the bottom board 330 in an open state or disaligned from the ball holes 331 in a stopping state in order to prevent the ball 4 from dropping down as shown in FIG. 3.

Figure 4:
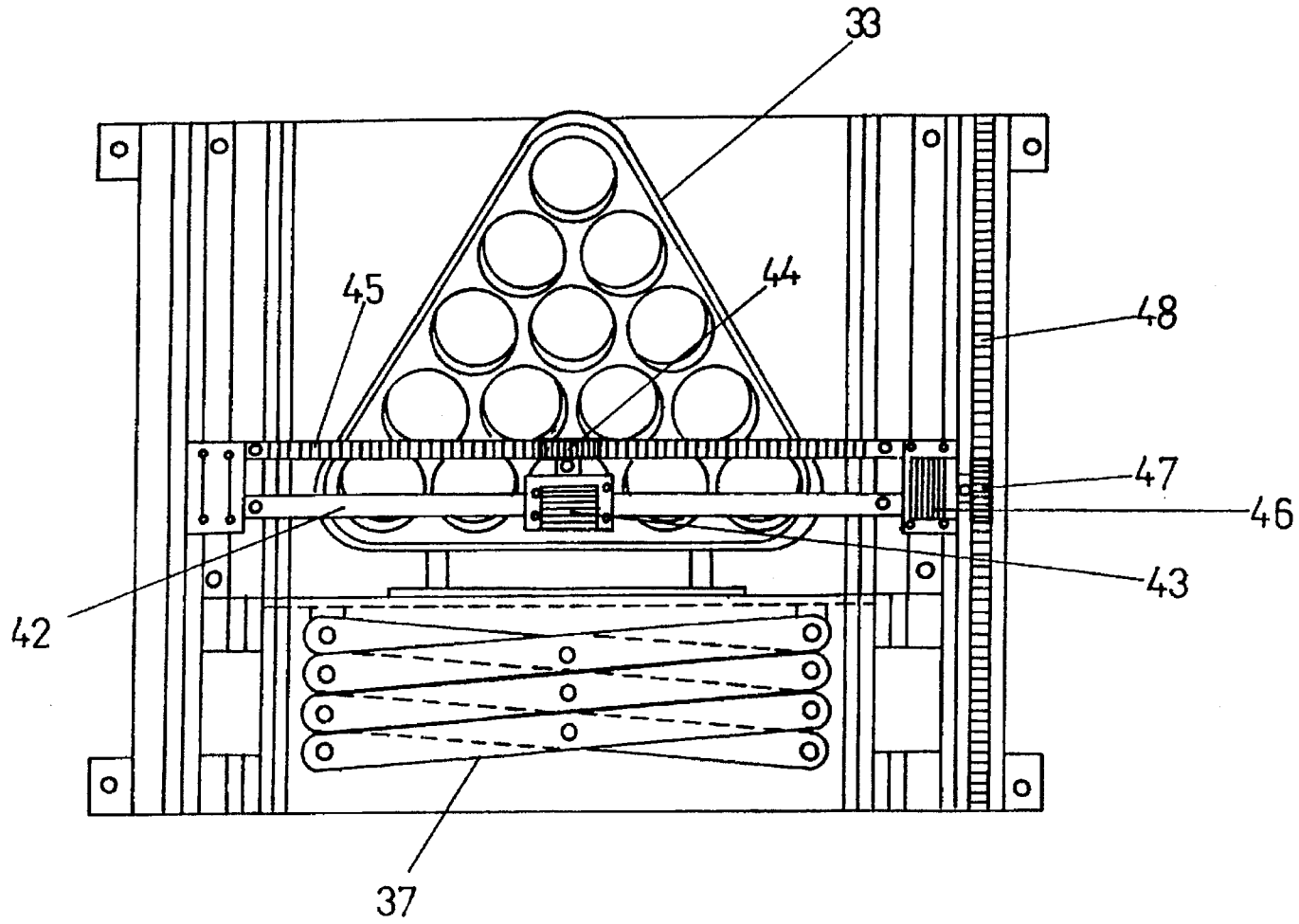
FIG. 4 is a top view of the present invention.
Figure 5:
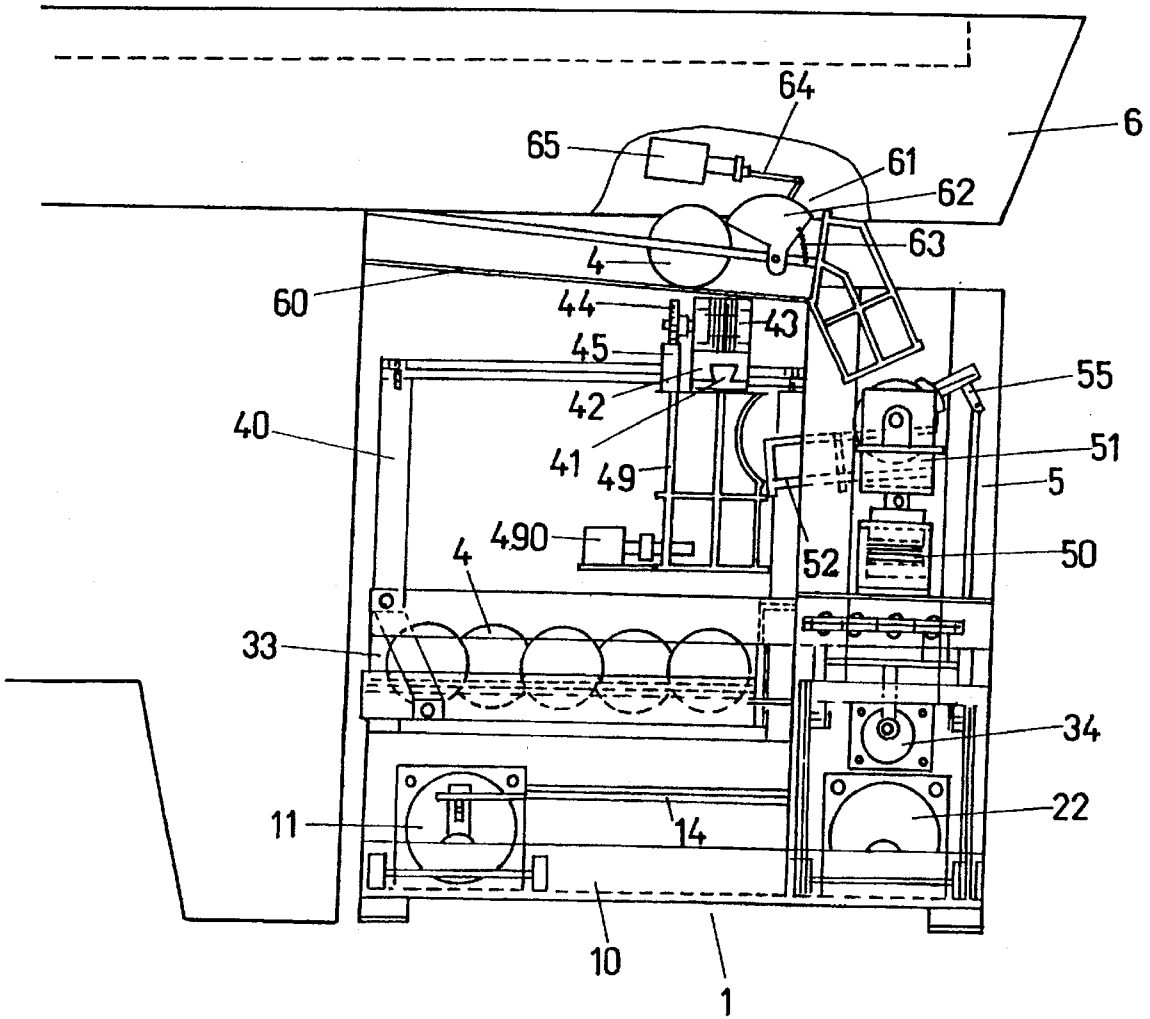
FIG. 5 is a side view showing a state of the operation of the present invention.

Please refer back to FIG. 1. A frame body 40 is disposed on the platform 10 of the base frame 1. A male and a female slide seats 41, 42 are disposed on the frame body 40. A servomotor 43 is disposed near a middle section of the female slide seat 42 and a pocket 49 is disposed under the male slide seat 41 corresponding to the servomotor 43 as shown in FIG. 5. A solenoid switch 490 with a stopper rod is disposed beside an opening of the pocket 49 for controlling the dropping of the ball 4 in the pocket 49. The output shaft of the servomotor 43 is engaged with a gear 44 meshing with a rack 45 parallelly disposed beside the male and female slide seats 41, 42, whereby the servomotor 43 can control the X axial movement of the pocket 49. Moreover, another servomotor 46 is disposed beside the male and female slide seats 41, 42 as shown in FIG. 4. The output shaft of the servomotor 46 is engaged with a gear 47 meshing with a rack 48 disposed on one side of the frame body 40, whereby the servomotor 46 can control the Y axial movement of the pocket 49.

Please refer to FIGS. 1 and 5. A longitudinal/latitudinal color sensor means 5 is disposed under the male and female slide seats 41, 42 on an outer side thereof. The sensor means 5 is connected to a U-shaped member 51 through the output shaft of a servomotor 50. The U-shaped member 51 has an open end coupled with a ball rail 52 which has a dropping opening opposite to and in alignment with a ball entrance of the pocket 49. In addition, a servomotor 53 is disposed on an outer side of the U-shaped member 51. The output shaft of the servomotor 53 is coupled with a disk 54 in the U-shaped member 51. A color sensing bar 55 is disposed beside the U-shaped member 51 and electrically connected with the servomotors 43, 46 by wires. After the color sensor means 5 senses the color of the ball 4, the color sensor means 5 inputs an X axis and a Y axis coordinate commands respectively to the servomotors 43, 46 of the male and female slide seats 41, 42 which operate to move the pocket 49 toward a position above a preset location of the ball in the ball holding tray 33.

Please refer to FIG. 5. A stopper valve 61 is disposed at a dropping opening of a collecting ball rail 60 of the billiard table 6. The stopper valve 61 has a stopper board 62 pivotally disposed on two lateral rail strips of the ball rail 60 and urged by an extension spring 63. A brake rod 64 is disposed above the stopper board 62 and controlled by a solenoid switch 65.

It should be appreciated that the respective servomotors, solenoid switches and color sensor means are preset with controlling flow chart so that the operation of the present invention is performed automatically in order. The wire layout of these elements pertains to prior art and will not be discussed in detail hereinbelow.

The above assembly of the present invention is mounted under the dropping opening of the collecting ball rail 60 of the billiard table 6. The operation of the assembly can be understood through FIG. 5 in which after the balls on the table are hit into the pockets one by one, the balls roll through the respective ball rails toward the dropping opening of the collecting ball rail 60 and are stopped by the stopper valve 61. The solenoid switch 64 drives the stopper board 62 to release and drop the balls 4 one by one onto the disk 54 of the sensor means 5 for sensing. It should be noted that when the stopped board 62 of the stopper valve 61 is opened to release a preceding ball 4, the next ball 4 will not drop down along with the preceding one. This is because that when the stopper board 62 is driven by the solenoid switch 64 with its front edge lifted for releasing the ball 4, its rear edge is simultaneously shoveled down to abut against a front side of the next ball 4. Therefore, when the stopper valve 61 is opened, only one ball 4 is permitted to drop into the color sensor means 5 for sensing. Several seconds after the ball 4 drops into the color sensing means 5, the solenoid switch 64 is restored and the stopper board 62 is forced by the extension spring 63 with its front edge restored to original stopping position for stopping the second ball 4.

When the ball 4 is dropped onto the disk 54 of the color sensor means 5 to be sensed by the color sensing bar 55, the servomotors 50, 53 operate to respectively rotate the U-shaped member 51 and the disk 54 through a certain angle so as to rotate the surface of the ball 4 for the color sensing bar 55 to sense the colors of the respective sides of the surface. After the color sensing bar 55 senses the colors of the ball 4, a command is input to a connected scorer for recording the points of the ball 4, and an X axis and a Y axis coordinate commands are respectively input to the servomotors 43, 46 of the male and female slide seats 41, 42 for subsequent operation. Thereafter, the servomotors further operate to rotate the disk through a larger angle, making the ball 4 thereof roll onto the ball rail 52 and through the ball rail 52 into the pocket 49. Then, the servomotors 43, 46 operate to move the male and female slide seats 41, 42 respectively along X axis and Y axis and shift the pocket 49 toward the position above the preset location of the ball in the ball holding tray 33. Then, the solenoid switch 490 of the pocket 49 is activated, permitting the ball 4 to drop into the designated ball hole 331 of the ball holding tray 33. The above procedure is repeated until all the balls on the table are hit down, sensed and rendered in the ball holding tray 33.

Figure 6:
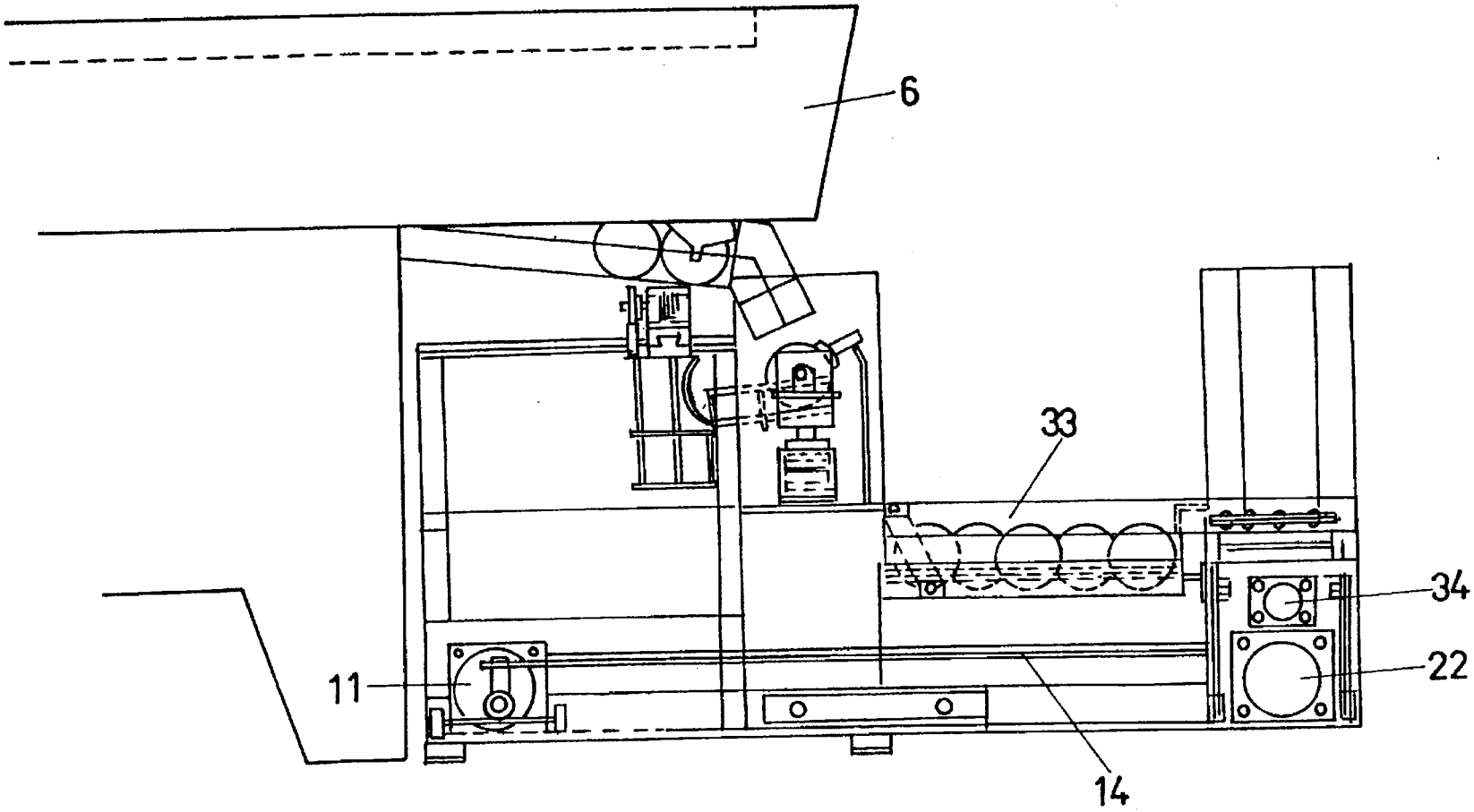
FIG. 6 is a side view showing another state of the operation of the present invention.
Figure 7:
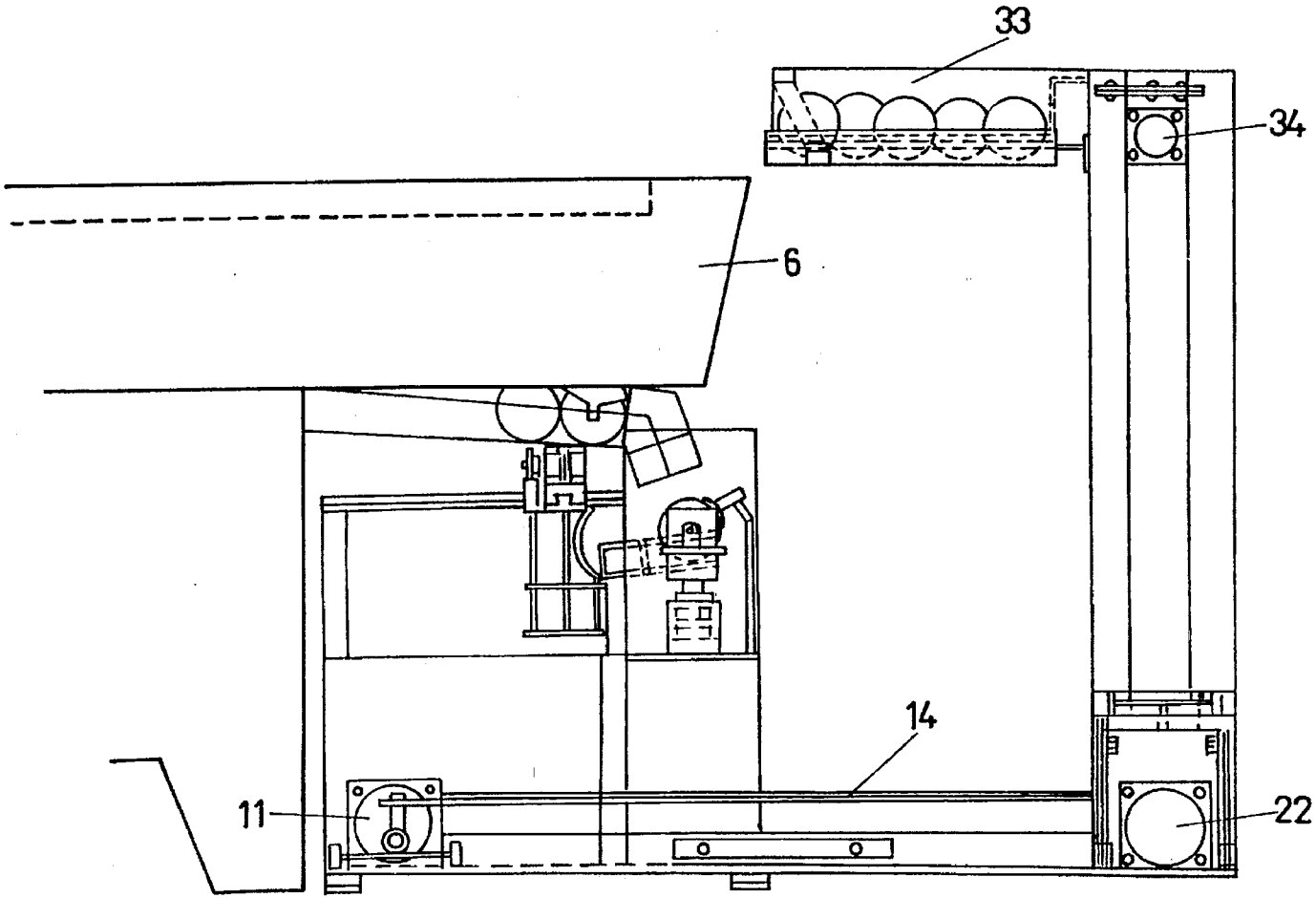
FIG. 7 is a side view showing still another state of the present invention.

Please refer to FIG. 6. After all the balls on the table are hit down, sensed and rendered in the ball holding tray 33, the servomotor 11 is activated to shift the thread sleeve 13 along the thread rod 12, making the elbow jointed lever 14 gradually extend outward in order to move the ball holding tray 33 outward to a position spaced from the billiard table 6 by a certain distance. Please refer to FIG. 7. After the ball holding tray 33 is moved outside the billiard table 6, the servomotor 22 drives the thread sleeve 24 along the thread rod 23, making the elbow jointed levers 26, 27 gradually extend upward in order to move the ball holding tray 33 upward to a position slightly above the billiard table 6.

Figure 8:
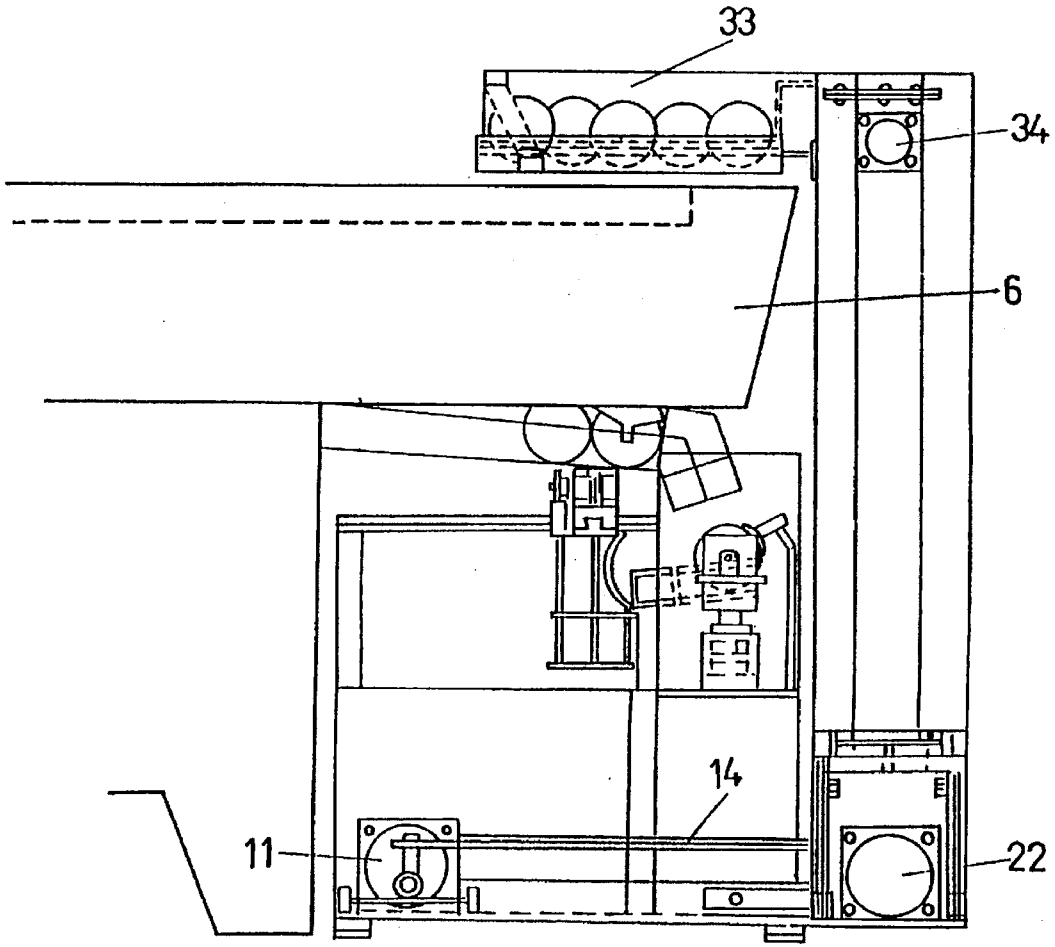
FIG. 8 is a side showing still another state of the present invention.
Figure 9:
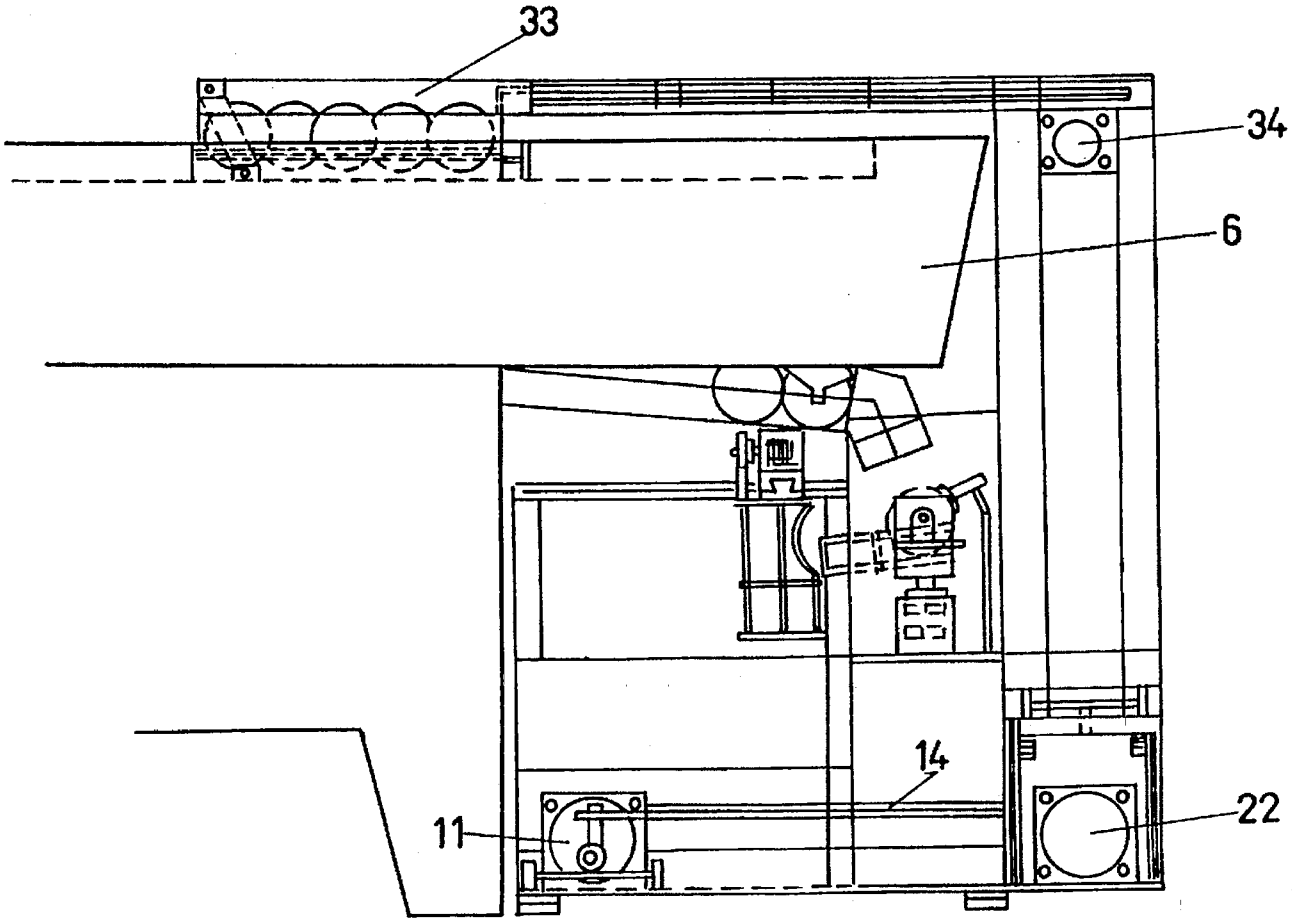
FIG. 9 is a side view showing still another state of the present invention.

Please refer to FIG. 8. Then the servomotor 11 on the platform 10 is again activated to retract the elbow jointed lever 14 so as to move the ball holding tray 33 forward to a position above one side of the billiard table 6. Thereafter, as shown in FIG. 9, the servomotor 34 drives the thread sleeve 36 along the thread rod 35, making the elbow jointed lever 37 extend forward so as to move the ball holding tray 33 forward to a preset triangular ball location of the billiard table 6. After the ball holding tray 33 reaches this location, the servomotor 22 on the platform 17 again operates to make the elbow jointed levers 26, 27 slightly retracted by a certain distance so that the ball holding tray 33 is descended to attach to the triangular location. Thereafter, the solenoid switch 337 of the ball holding tray 33 operates to shift the stopper board 332, making the through holes 338 aligned with the ball holes 331 of the bottom board 330 into a fully open state. Consequently, the balls 4 rested on the bottom board 330 drop down onto the preset triangular location of the billiard table.

After the balls 4 are dropped to rest on the preset triangular location, the servomotor 22 on the platform 17 again operates to slightly upward extend the elbow jointed levers 26, 27 by a certain distance with the ball holding tray 33 separating from the billiard table 6. Also, the solenoid switch 337 again operates to restore the stopper board 332 with the through holes 338 thereof slightly disaligned from the ball holes 331 of the bottom board 330 for holding the subsequently hit down balls 4. Thereafter, the respective elements reversely operate to restore the ball holding tray 33 back to its home position as shown in FIG. 5, ready for the hit down balls 4 in next game.

It should be noted that the travels in the respective steps of the present invention are previously set up so that the respective elements of the present invention are accurately moved and located without error.

Figure 10:
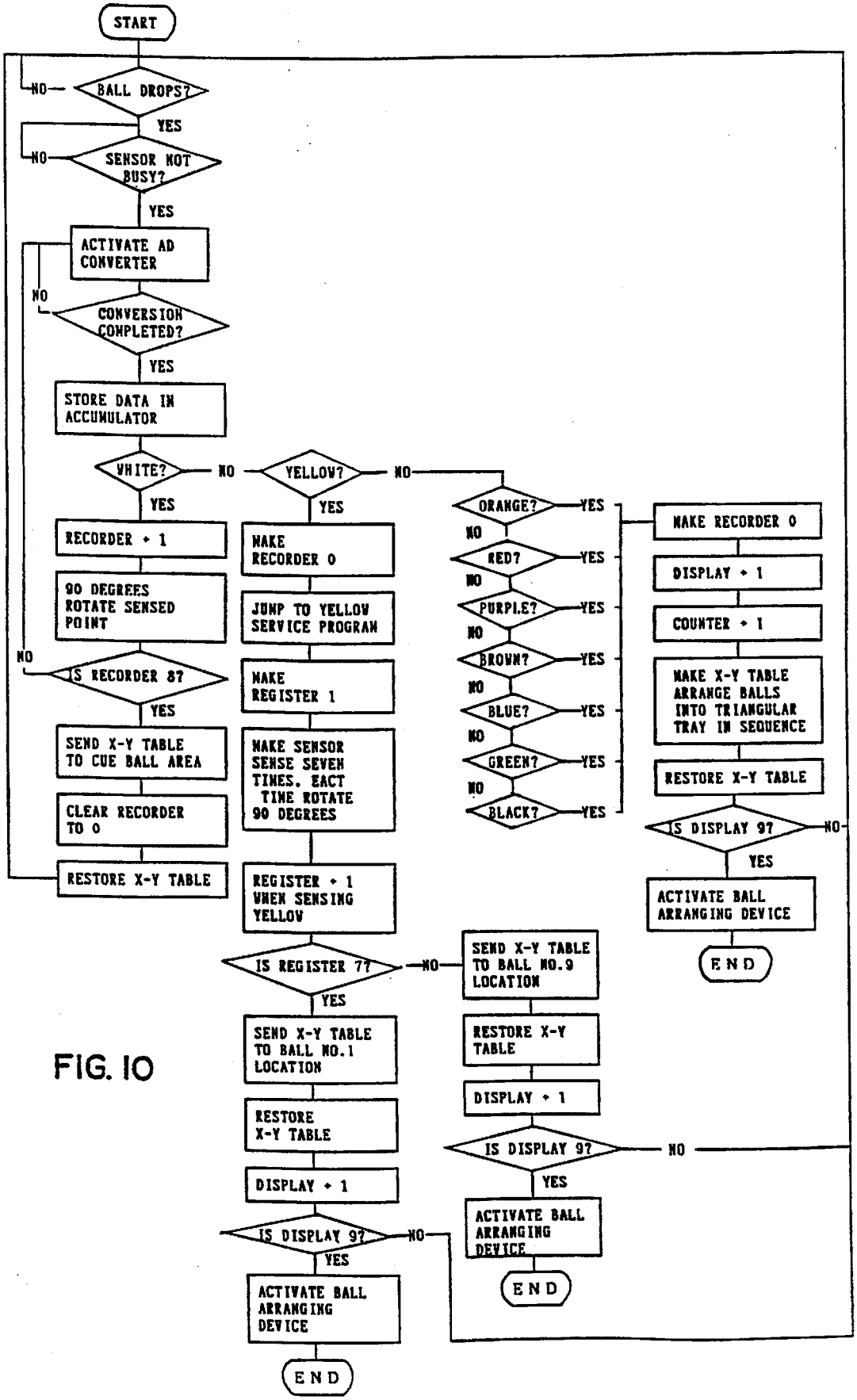
FIG. 10 is a flow chart for operation with respect to the game of nine-ball.
Figure 11:
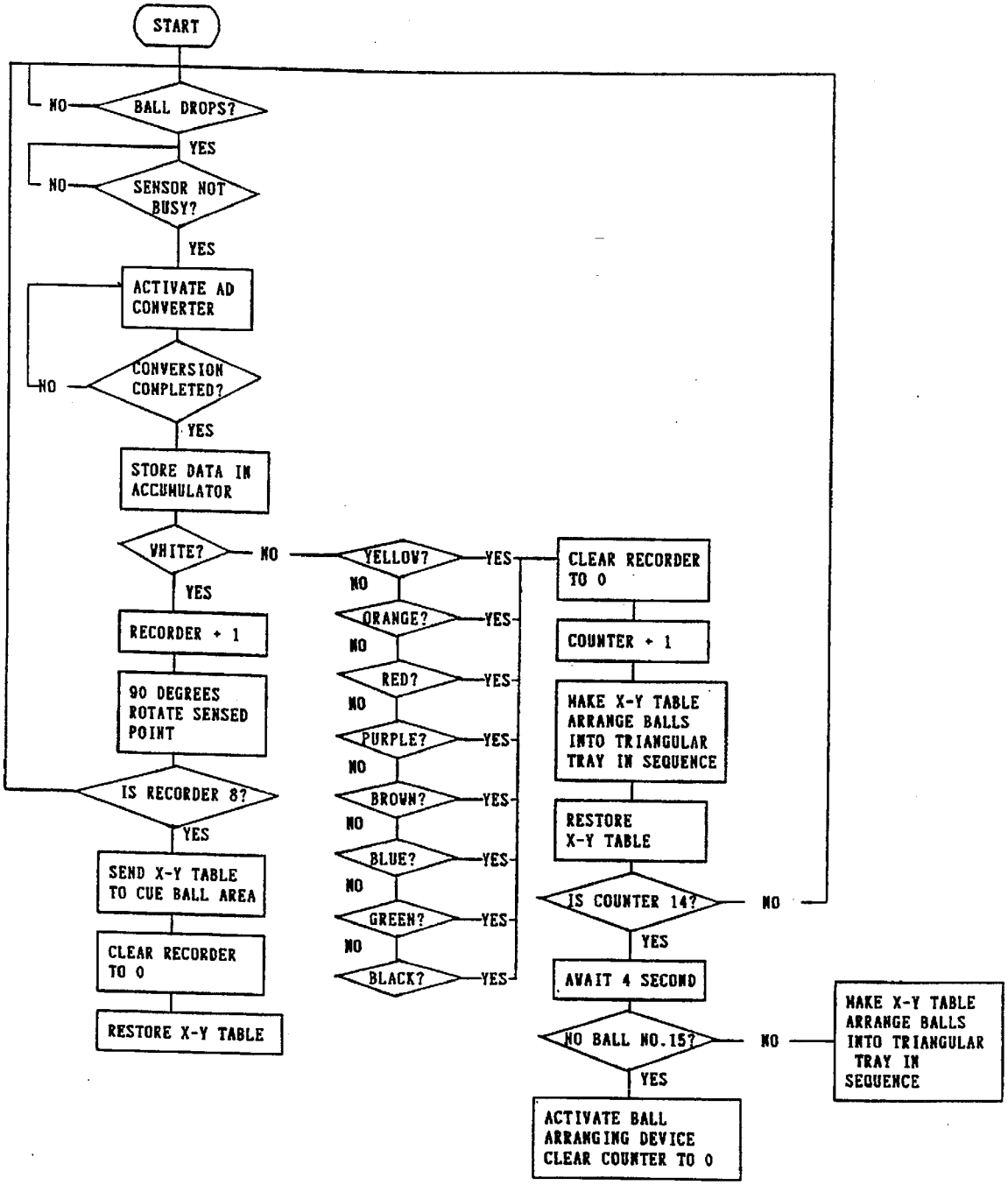
FIG. 11 is a flow chart for operation with respect to the game of fourteen-one; and, FIG. 12 is a flow chart for operation with respect to the game of snooker.
Figure 12:
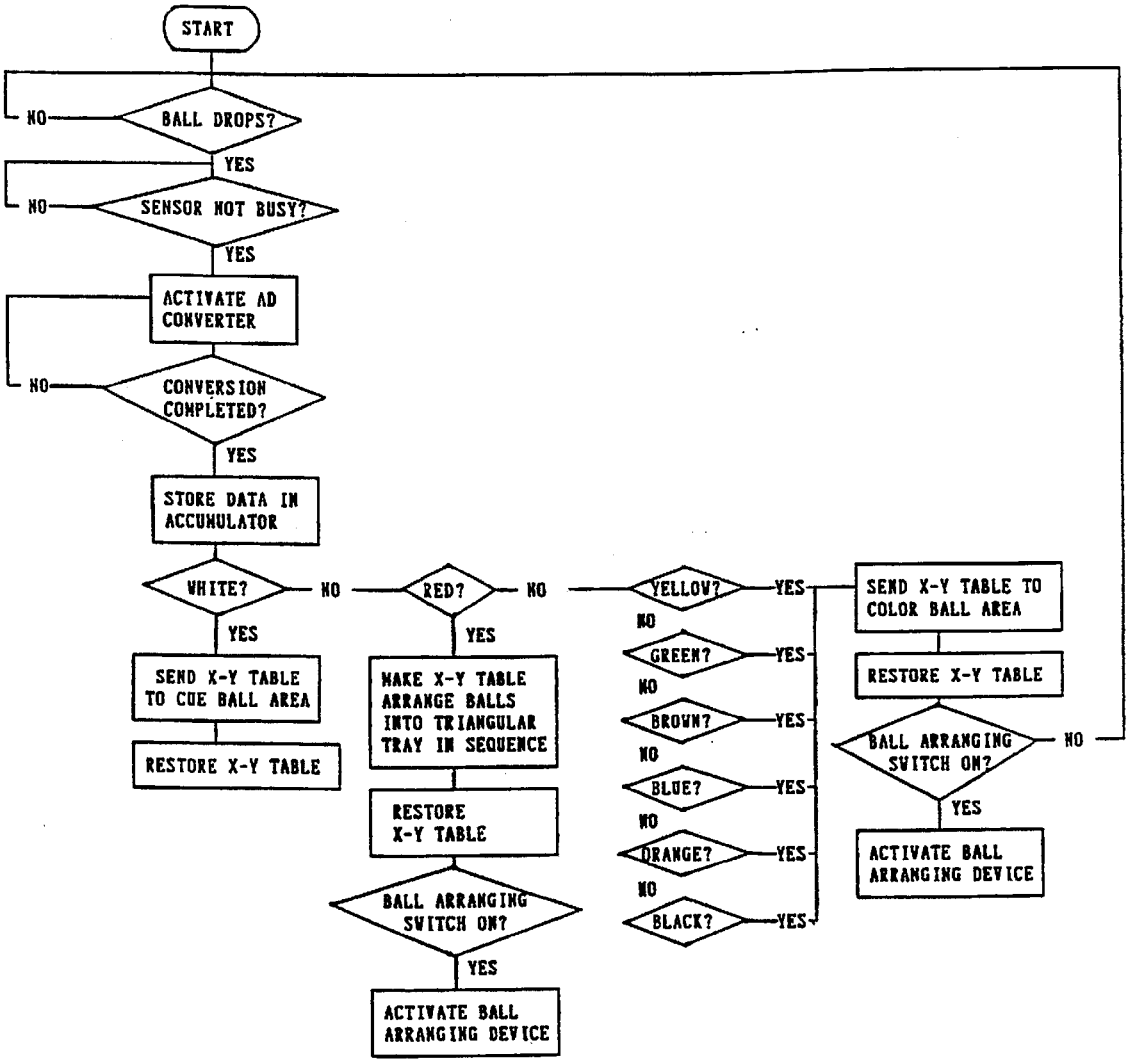

For illustration of the application of the present invention, FIGS. 10, 11, and 12 exemplify the operation of the present invention respectively with the games of nine-ball, fourteen-one and shocker.

It is to be understood that the above description and drawings are only used for illustrating one embodiment of the present invention, not intended to limit the scope thereof. Any variation and derivation from the above description and drawings should be included in the scope of the present invention.

What is claimed is:

1. A device used with billiard table for sensing balls dropping into the pockets and scoring as well as collecting and arranging the balls, said device comprising:

a servomotor disposed on a platform on one side of a base frame, an output shaft of the servomotor being connected with a thread rod, a thread sleeve being screwed on the thread rod and pivotally connected with an elbow arm of an extensible elbow jointed lever, an other elbow arm of the elbow jointed lever being pivotally connected with a surface of the servomotor, two rail tubes being respectively disposed along a front and a rear sides of the platform, several telescopically slidable rail bars being fitted in each rail tube, between a last slidable rail bar of the slidable rail bars being connected another platform, the other ends of the elbow arms of the elbow jointed lever being pivotally connected with the another platform;

four vertical rail tubes respectively disposed on four corners of the another platform, several telescopic slidable rail bars being fitted in each rail tube, a servomotor being disposed on a portion of the platform with its output shaft coupled with a thread rod, a thread sleeve being screwed on the thread rod, two sides of the thread sleeve being pivotally connected with an elbow arm of each of two elbow jointed levers, the other elbow arm of each elbow jointed lever being pivotally connected with a surface of the servomotor, between each two last slidable rails fitted in the rail tubes being connected a support beam,, the other ends of the elbow arms of the elbow jointed levers being respectively pivotally connected to the support beams;

a seat board connected between the ends of the last rail bars, two rail tubes being respectively disposed along a front and a rear sides of the seat board, several telescopic slidable rail bars being fitted in each rail tube, between the ends of the last slidable bars being connected a beam member, under the beam member being connected interconnecting plates for connecting with a ball holding tray, a servomotor being disposed under the seat board, an output shaft of the servomotor being connected with one end of a thread rod, on the thread rod being screwed a thread sleeve which is pivotally connected with an elbow arm of an extensible elbow jointed lever, the other elbow arm of the elbow jointed lever being pivotally connected with a surface of the servomotor, the other ends of the elbow arms of the elbow jointed lever being pivotally connected with the beam member;

a ball holding tray having a bottom board formed with multiple ball holes arranged as a triangular pattern, a stopper board being disposed immediately adjacent to a lower face of the bottom board, the stopper board having the same shape as the bottom board and formed with the same number, size and pattern of through, holes as the bottom board, the through holes being slightly eccentrical from the ball holes of the bottom board so that the edges of the through holes can stop the balls in the ball holes from dropping down from the ball holding tray, the stopper board being engaged with the bottom board in such a manner that at least one front insertion pin and at least one rear insertion pin are respectively disposed at a front and a rear ends of the stopper board and inserted through a front and a rear flanges of the ball holding tray, a spring being disposed between each insertion pin and the flange, a solenoid switch being disposed at an outer end of the front insertion pin for controlling the forward or rearward movement of the stopper board;

a frame body disposed on the platform of the base frame, a male and a female slide seats being disposed on the frame body, a servomotor being disposed near a middle section of the female slide seat and a pocket being disposed under the male slide seat corresponding to the servomotor, a solenoid switch with a stopper rod being disposed beside an opening of the pocket for controlling the dropping of the ball in the pocket, an output shaft of the servomotor being engaged with a gear meshing with a rack parallelly disposed beside the male and female slide seats, whereby the servomotor can control the X axial movement of the pocket, another servomotor being disposed beside the male and female slide seats, an output shaft of the servomotor being engaged with a gear meshing with a rack disposed on one side of the frame body, whereby the servomotor can control the Y axial movement of the pocket;

a longitudinal/latitudinal color sensor means disposed under the male and female slide seats on an outer side thereof, the sensor means being connected to a frame member through the output shaft of a servomotor, the frame member having an open end coupled with a ball rail which has a dropping opening opposite to and in alignment with a ball entrance of the pocket, a servomotor being disposed on an outer side of the frame member, an output shaft of the servomotor being coupled with a disk in the frame member, a color sensing bar being disposed beside the frame member and electrically connected with the servomotors of the male and female slide seats by wires, whereby after the color sensor means senses the color of the ball, the color sensor means inputs an X axis and a Y axis coordinate commands respectively to the servomotors of the male and female slide seats which operate to move the pocket toward a position above a preset location of the ball in the ball holding tray; and a stopper valve disposed at a dropping opening of a collecting ball rail of the billiard table, the stopper valve having a stopper board pivotally disposed on two lateral rail strips of the ball rail and urged by an extension spring, a brake rod being disposed above the stopper board and controlled by a solenoid switch, said device being mounted under the dropping opening of the collecting ball rail of the billiard table for sensing the balls hit down into the pocket and automatically scoring as well as locating the balls into the location in the ball holding tray, after all the balls on the table are hit down, sensed and rendered in the ball holding tray, the device automatically rearranging the balls in the preset triangular location on the billiard table for next game.

* * * * *